United States Patent [19]

Howe et al.

[11] Patent Number: 4,674,955

[45] Date of Patent: Jun. 23, 1987

[54] RADIAL INBOARD PRESWIRL SYSTEM

[75] Inventors: William J. Howe; Duane B. Bush, both of Tempe; Erian A. Baskharone, Scottsdale, all of Ariz.

[73] Assignee: The Garrett Corporation, Los Angeles, Calif.

[21] Appl. No.: 684,650

[22] Filed: Dec. 21, 1984

[51] Int. Cl.[4] ..... F01D 5/18

[52] U.S. Cl. ..... 416/95; 415/115

[58] Field of Search ..... 416/95, 96, 97 R; 415/115, 116

[56] References Cited

U.S. PATENT DOCUMENTS

| | | | |
|---|---|---|---|
| 3,768,921 | 10/1973 | Brown et al. | 415/116 |
| 3,826,084 | 7/1974 | Branstrom et al. | 415/115 |
| 3,832,090 | 8/1974 | Matto | 416/97 R |
| 3,853,425 | 12/1974 | Scalzo et al. | 416/95 |
| 3,936,215 | 2/1976 | Hoff | 415/115 |
| 3,990,812 | 11/1976 | Radtke | 416/95 |
| 4,008,977 | 2/1977 | Brown et al. | 415/1 |
| 4,086,757 | 5/1978 | Karstensen et al. | 416/115 |
| 4,187,054 | 2/1980 | Landis, Jr. et al. | 415/115 |
| 4,236,869 | 2/1980 | Laurello | 416/95 |
| 4,302,148 | 11/1981 | Tubbs | 415/115 |
| 4,453,888 | 6/1984 | Hovan et al. | 416/96 R |
| 4,456,427 | 6/1984 | Evans et al. | 415/115 |
| 4,541,774 | 9/1985 | Rieck et al. | 415/115 |

FOREIGN PATENT DOCUMENTS

| | | |
|---|---|---|
| 2003947 | 7/1970 | Fed. Rep. of Germany . |
| 2043480 | 4/1971 | Fed. Rep. of Germany . |
| 2047648 | 5/1971 | Fed. Rep. of Germany . |
| 2633222 | 1/1978 | Fed. Rep. of Germany . |
| 2633291 | 1/1978 | Fed. Rep. of Germany . |
| 0037897 | 3/1981 | Fed. Rep. of Germany . |
| 2209041 | 6/1974 | France . |
| 2381179 | 9/1977 | France . |
| 843278 | 8/1960 | United Kingdom . |
| 1194663 | 6/1970 | United Kingdom . |
| 1270905 | 4/1972 | United Kingdom . |
| 2054046 | 2/1981 | United Kingdom . |
| 2100360 | 12/1982 | United Kingdom . |

*Primary Examiner*—Robert E. Garrett
*Assistant Examiner*—John Kwon
*Attorney, Agent, or Firm*—Leslie S. Miller; Curt L. Harrington; Albert J. Miller

[57] ABSTRACT

An arrangement for supplying coolant flow to turbine blades in a gas turbine engine is disclosed which utilizes a preswirl assembly to impart a tangential velocity to the coolant flow substantially greater than the tangential velocity of the rotor at the point at which the air is supplied to the rotor. The overswirled air is injected radially inwardly into an internal passage contained in the rotor, and the coolant flow continues to be an overswirled condition within the internal passageway. The amount of overswirl imparted to the coolant flow is such that the tangential velocity of the coolant flow is greater than the tangential velocity of the blades at the location on the blades the coolant flow is supplied to the blades for blade cooling, thereby resulting in substantially improved efficiency in the cooling system.

9 Claims, 10 Drawing Figures

FIG. 1
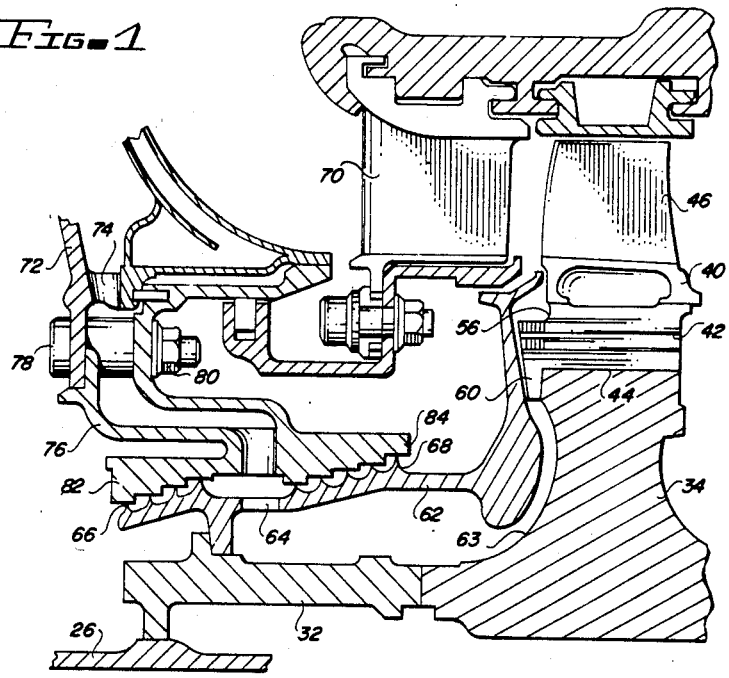
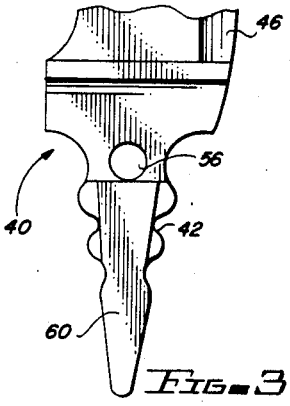
FIG. 3
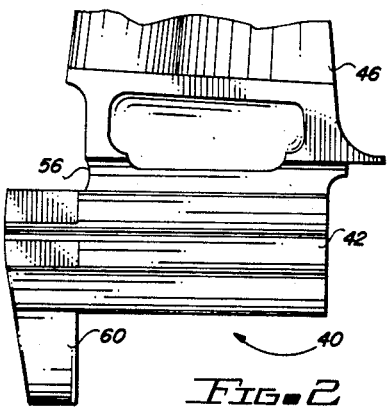
FIG. 2
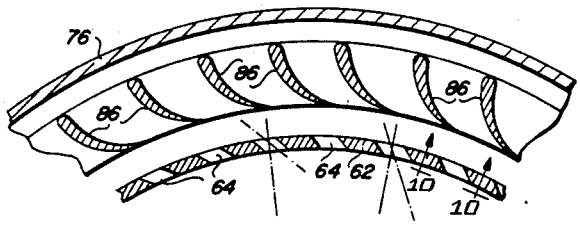
FIG. 4

RADIAL INBOARD PRESWIRL SYSTEM

BACKGROUND OF THE INVENTION

This invention relates to gas turbine engines, and more particularly to an arrangement for supplying cooling air to turbine blades in a gas turbine engine having high turbine inlet gas temperatures.

Gas turbine engines typically comprise sequentially a compressor, a combustion section, and a turbine. The compressor pressurizes air in large quantities to support combustion of fuel in order to generate a hot gas stream for power generation. The combustion area is located downstream of the compressor, and jet fuel is mixed with the pressurized air in the combustion area and burned to generate a high pressure hot gas stream, which stream is then supplied to the turbine. The hot gas stream is directed by a plurality of turbine vanes onto a number of turbine blades mounted in rotating fashion on a shaft, with the hot gas stream causing the turbine to rotate at high speed, which rotation powers the compressor. The turbine goes through several stages, although the highest temperatures and hence the most hostile environment is produced where the hot gas stream enters the turbine, namely in the blades of the first turbine stage.

The turbine blades, particularly in the first stage, must therefore be fabricated of high temperature alloys in order to withstand not only the high temperatures of the hot gas stream but the substantial centrifugal forces generated by the high speed rotation of the turbine rotor. As turbine engines have been refined to become more energy efficient and deliver a higher output-to-weight ratio, while maintaining extended operating lifetimes with long periods between overhauls, it has become absolutely essential to deliver a cooling fluid to the turbine blades, particularly in the first stage. This cooling fluid, which is typically relatively cool air derived from the compressor, must be delivered through an internal passage in the rotor, which is rotating at high speed, to the turbine blades. These blades are typically provided with internal passages into which the coolant air is supplied, thereby enabling the turbine blades to survive the high temperature working environment which would otherwise destroy or critically damage them.

While arrangements for supplying cooling air from the compressor to internal passages in the turbine blades have been around for some time, an ever increasing concern has been the loss in efficiency of operation of the turbine caused by diverting the cooling fluid from the compressor to the turbine blades. While it is apparent that engine performance is reduced somewhat by the bleeding off of cooling air, maximizing the efficiency of the apparatus supplying the cooling air from the compressor to the turbine blades has been a series of responses to one type of loss rather than an effective analysis and response to the several different types of losses encountered in supplying cooling fluid to rotating turbine blades.

These losses include insertion losses and pumping losses. Insertion losses are encountered at the point at which the cooling air enters the turbine rotor, which is moving with a fairly high tangential velocity. These insertion losses require first that the cooling air be supplied to the turbine rotor at a minimal radius, thereby reducing the differential in tangential velocity of the rotor to the non-rotating air delivery system used to supply cooling air to the rotor.

Insertion losses include three critical losses. First, since most air delivery systems operate at fairly high static air pressures, losses in the seal areas between the turbine rotor and the stationary portion of the turbine have been high, reducing overall efficiency and requiring large quantities of air to be diverted from the compressor for cooling purposes. Secondly, frictional losses accompanying the injection of cooling air into the rotor reduce efficiency as well as drop air pressure significantly, further aggravating the seal problem by requiring higher delivery pressures. Thirdly, there are associated insertion losses known collectively as swirl loss, which is primarily the loss caused by the necessity for rotationally accelerating the cooling air once it is contained in the turbine rotor up to the tangential velocity of the turbine rotor. An additional smaller component of swirl loss is due to friction of the cooling air stream within the turbine rotor.

Finally, pumping losses are the losses encountered as the cooling air is supplied from the smaller radius at which it enters the turbine rotor to the larger radius at the base of the turbine blades, the point at which the cooling air is supplied to the turbine blades. The addition of pumping vanes or blades to add pressure to the cooling air to enable delivery to the turbine blades adds heat to the cooling air, as well as acting as a drag force on the rotor since work must be done to pump the cooling air to the turbine blades.

Accordingly, it can be seen that it is desirable to minimize these losses while supplying sufficient cooling air to the turbine blades through an air delivery system which performs only a minimal amount of work on the cooling air, thereby not heating and reducing the efficiency of the cooling air supplied to the turbine blades. In addition to being highly efficient, the cooling air delivery system must not reduce the structural integrity of the turbine rotor. In addition, it is desirable that a high pressure delivery system be avoided to prevent substantial air leakage at the point the air is transferrred from the stationary portions of the turbine engine to the turbine rotor.

The art in this area has concentrated for the most part on a single approach to more efficiently supply cooling air to turbine blades, namely, by imparting some degree of swirl to the cooling air before it is supplied to the turbine rotor, thereby minimizing some portion of the insertion losses. This technique to some degree will also reduce swirl loss, inasmuch as if it is performed effectively the cooling air is brought to a tangential velocity equaling the tangential velocity of the turbine rotor at the point at which the cooling air is supplied to the turbine rotor.

An early reference utilizing this approach is U.S. Pat. No. 2,910,268, to Davies et al, which is an apparatus for tapping air from a compressor section of a turbine engine and providing it to the interior portion of the shaft of a turbine rotor. While the Davies device was extremely ineffective and only marginally reduced insertion losses, succeeding references have further improved the technique of preswirling the cooling air so as to reduce some components of insertion losses and also somewhat reduce swirl loss. Such references include U.S. Pat. No. 2,988,325 to Dawson, U.S. Pat. No. 3,602,605 to Lee et al, and U.S. Pat. No. 3,936,215. These references use either stationary vanes or stationary nozzles to direct the cooling air in a rotary fashion prior to injecting the cooling air into cooling passages in the turbine rotor. By preswirling the cooling air, insertion losses are reduced somewhat. In addition, swirl losses at the point of injection are minimized, although when the cooling air travels through the internal passages in the turbine rotor, these swirl losses are generally not substantially reduced by the art.

These devices all possess significant problems in delivering the cooling air to the turbine blades, in that they require a primary design choice to be made. If cooling air is supplied at high pressure to the turbine rotor, there is a substantial leakage problem resulting in the loss of a significant percentage of the cooling air and resulting in reduced efficiency in the cooling operation. The other alternative involves supplying cooling air at a somewhat lower pressure and utilizing a pumping vane to move the air from the interior of the turbine rotor outward to the turbine blade. This technique necessarily involves performing a substantial amount of work on the cooling air, decreasing the efficiency of the cooling operation and causing drag on the turbine wheel as well as increasing the temperature of the cooling air supplied to the turbine blades. An example of such a pumping blade is shown in U.S. Pat. No. 3,602,605, to Lee et al.

It is therefore apparent that a substantial need exists for a more efficient way of supplying cooling air to turbine blades without requiring either high pressure supply and the resulting leakage of cooling air through the seals or the use of pumping vanes to supply air from the smaller radius at which the air is injected into the turbine rotor to the larger radius at the base of the turbine blades.

SUMMARY OF THE INVENTION

The present invention utilizes cooling air tapped off from the compressor and diverted to a stationary annular preswirl assembly surrounding a portion of the turbine rotor. The preswirl assembly imparts a rotary or tangential velocity to the cooling air substantially greater than the rotary or tangential velocity of the rotor at the point at which the air is supplied to the rotor, thereby resulting in an overswirl condition providing several advantages which will be mentioned later.

The overswirled air is injected radially inwardly by the preswirl assembly, and enters into an internal passage in the rotor through a plurality of apertures in the cover plate or seal plate of the turbine rotor. Air leakages are minimized during this injection of the cooling air into the turbine rotor by labyrinth seals formed by the seal plate which rotate closely adjacent the preswirl assembly. An advantage of the present invention is that by overswirling the cooling air static pressure of the cooling air is reduced while dynamic pressure is increased. The reduction in static pressure of the cooling air prior to the air reaching the labyrinth seal results in substantially lower leakage of cooling air through the labyrinth seal.

Following the overswirling of the cooling air by the preswirl assembly and injection through a plurality of apertures in the seal plate, which apertures are preferably angled to minimize losses as the overswirled cooling air passes therethrough, the cooling air is still moving in an overswirled condition, meaning it is moving with a substantially greater tangential velocity than is the turbine rotor itself. This overswirl condition results in the cooling air having a substantial dynamic pressure component which may be recovered to obtain sufficient pressure to supply the cooling air to the blades of the turbine rotor, which are arranged in a radially outwardly extending fashion around the turbine rotor.

The internal passage in the turbine rotor leads radially outwardly towards the base of the blade assemblies, and the points to which the cooling air is supplied to the blades. Since the cooling air is in an overswirl condition, it will move radially outward with an increasing static pressure without requiring any pumping or other external operation to force it radially outwardly. In other words, the cooling air will move radially outwardly with an substantially increasing static pressure as long as the tangential velocity of the cooling air is greater than the tangential velocity of the turbine wheel at the particular radius at which the cooling air is located, thereby enabling the supply of cooling air at a sufficient pressure to the blades without pumping.

This overswirl condition enables a reduction in the pumping losses which are so significant in prior techniques of supplying cooling air to the turbine blades. With the reduction of the pumping losses, less work need be done on the cooling air, and therefore the cooling air will be supplied to the turbine blades at a lower temperature.

In the preferred embodiment, small pumping vanes are formed integrally with the blade assemblies and are utilized to increase pressure of the cooling air immediately prior to supplying the cooling air to the blades. The use of a small pumping vane formed integrally with each of the blade assemblies enables greater aerodynamic efficiency in overall operation of the cooling system, thereby providing sufficient coolant at a sufficient pressure to the blades. An aperture called a blade cooling entry channel is formed in each of the blades and leads to, in the preferred embodiment, a plurality of cooling passages in the blades leading radially outward. The cooling air is supplied to this blade cooling entry channel, and then to the cooling passages located inside these turbine blades. By supplying the cooling air to the blades, operation of the blades at a higher operating temperature is thereby enabled.

The present invention provides a number of significant advantages in operation when contrasted to prior devices. The technique of overswirling and providing angled apertures in the seal plate reduces wheel drag substantially, and thereby minimizes the insertion losses caused by wheel drag. By overswirling the air and reducing the static pressure at the labyrinth seal location, low seal leakage occurs, thereby further reducing insertion losses.

By minimizing the requirement for pumping the cooling air, the pumping losses are also minimized and the temperature of the cooling air provided to the blades is minimized. Overswirling also results in an increased static pressure of cooling air at the supply point to the blade.

Since the preswirled air is injected radially inboard through apertures in the seal plate at a radius substantially smaller than the radius at the base of the blade assemblies, the design reduces substantially stresses in the seal plate and totally eliminates stress concentrations in the rotor disc itself.

The overall configuration of the present invention results not only in higher operating efficiencies of the cooling system, but since seal losses are substantially smaller due to lower pressure at the seal location, larger seal clearances may be tolerances in which case the seal becomes less sensitive to tolerances and rubs, thereby also reducing somewhat the cost of machining the seals.

It may therefore be appreciated that the present invention provides cooling air at an acceptable pressure to the turbine blades by using the overswirl technique to efficiently supply air to the turbine rotor while minimizing insertion losses. Since the cooling air is overswirled, pumping losses are also minimized and cooling air temperatures are kept at a lower level than prior devices. The present invention therefore represents a substantial improvement in cooling system design for gas turbine engines.

DESCRIPTION OF THE DRAWINGS

These and other advantages of the present invention are best understood through reference to the drawings, in which:

FIG. 1 is a cutaway view of the turbine portion of a gas turbine engine showing the preswirled cooling air supply system of the present invention;

FIG. 2 is a view of the base portion of a blade assembly used in the rotor of the device shown in FIG. 1;

FIG. 3 is a side view of the base portion of the blade assembly shown in FIG. 2 showing the blade cooling entry channel;

FIG. 4 is a partial cross-sectional view of the preferred embodiment of the present invention utilizing preswirl vanes in the preswirl assembly of FIG. 1;

DETAILED DESCRIPTION OF THE PREFERRED EMBODIMENT

Figures 5, 6, 7:
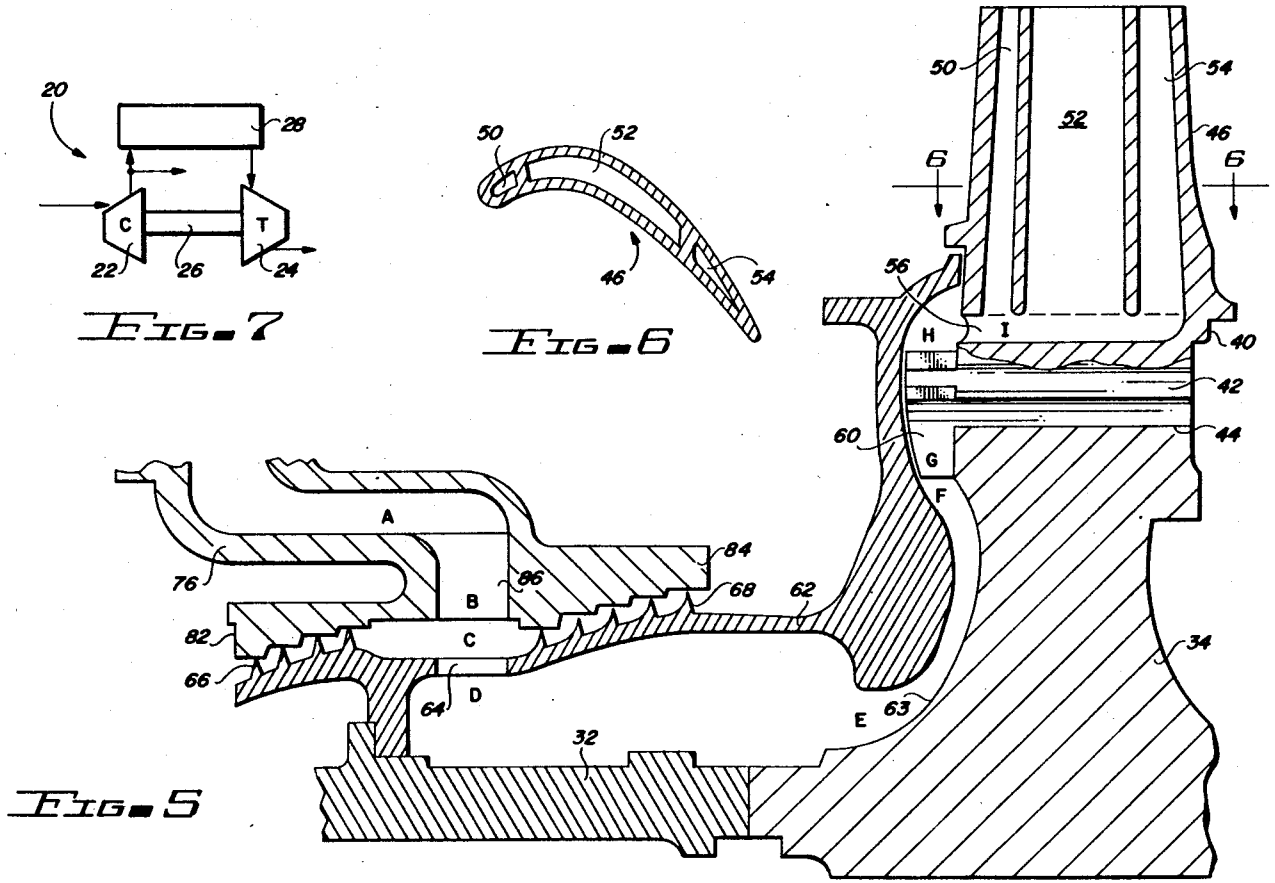
FIG. 5 is an enlarged view of the device shown in FIG. 1 illustrating the cooling flow path of the cooling air as it is supplied to a blade, with the blade cut away to show the internal cooling air passages.
FIG. 6 is a cross-section of the blades shown in FIGS. 1 and 5 illustrating the configuration of the cooling air passages contained therein.
FIG. 7 is a schematic depiction of the overall system containing the cooling air supply scheme of the present invention.

Referring to FIG. 7, a schematic depiction of a gas turbine engine 20 is illustrated with a compressor 22, a turbine 24, and a shaft 26 mechanically linking the compressor 22 to the turbine 24. The flow path of air through the turbine engine 20 is indicated by arrows in FIG. 7, and is shown to be into the compressor 22 and from the compressor 22 to a combustor 28. A hot gas stream supplied by the combustor 28 then goes to drive the turbine 24, and is then exhausted from the turbine engine 20. A portion of the air coming from the compressor 22 is diverted before it is supplied to the combustor 28, and this portion of air is the coolant flow used to cool the blades of the turbine rotor.

Moving now to FIG. 1, a portion of the turbine 24 of a turbine engine 20 is illustrated in cutaway fashion. The assemblage illustrated may be easily separated into two halves, the stationary portion and the turbine rotor. The rotor illustrated in FIG. 1 shows a single stage, although it will be realized by those skilled in the art that the present invention may be adapted for use in either single or multistage gas turbines.

The various components of the rotor are all mounted upon the shaft 26, which rotates and carries the various components of the rotor with it. An annular coupling member 32 is carried on the shaft 26, and rotates with the shaft 26. A rotor disc 34 for carrying a plurality of blades is mounted between the annular coupling member 32 and various other hardware not illustrated in FIG. 1 but of standard design in the art. The annular coupling member 32 and the rotor disc 34 are joined together by a curvic coupling, also of standard design in the art. A plurality of blade assemblies 40 are mounted onto the rotor disc 34 in annular fashion, preferably by the fitting of a blade attachment or firtree 42 of the configuration shown in FIG. 3 into a mating groove 44 contained in the rotor disc 34. The blade assembly 40 includes a radially outwardly extending blade 46, as shown in FIG. 1.

The blade 46 contains a plurality of internal cooling passages 50, 52, and 54, best shown in FIGS. 5 and 6. Cooling air is supplied to the blade assembly 40 by providing the coolant flow under pressure to an aperture in the blade attachment called the blade cooling entry channel 56, as shown in FIGS. 3 and 5. The coolant flow is distributed to the cooling passages 50, 52, and 54 by the blade cooling entry channel 56, as shown in FIG. 5.

Since the present invention uses overswirled cooling air, pumping vanes or blades are for the most part unnecessary. As long as the tangential velocity of the overswirled cooling air is greater than the tangential velocity of the rotor at a particular radius, the coolant flow will continue to significantly increase in static pressure without the use of pumping vanes or blades.

In the preferred embodiment, a small pumping vane 60 is formed integrally with the blade 46, and is used to boost the pressure of the coolant flow somewhat before it is supplied to the blade cooling entry channel 56. It should be noted that while the pumping vane 60 is not always necessary, it enables both greater overall aerodynamic efficiency and lower losses in the seal locations while providing a sufficient amount of coolant flow to the blades 46. The pumping vane is best shown in FIGS. 2 and 3.

Figure 10:
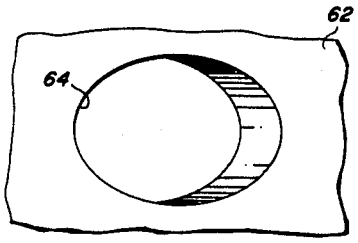
FIG. 10 is a partial plan view of one of the angled apertures in the seal plate shown in FIGS. 1, 5, and 8.

Returning to FIG. 1, the final element in the rotor is a cover plate or seal plate 62, which is compressively loaded between the annular coupling member 32 and the blade assemblies 40. The seal plate 62, together with the annular coupling member 32 and the forward face 63 of the rotor disc 34, forms an internal passageway inside the rotor through which coolant flow moves. The seal plate 62 includes a plurality of apertures 64 shown in FIGS. 1, 4, and 10, which are angled to increase efficiency and are preferably of an oval configuration as shown in FIG. 10. The seal plate 62 also includes labyrinth seals 66 and 68 on either side of the apertures 64, which labyrinth seals 66, 68 cooperate with stationary portions of the device which will be described later.

A pluralty of nozzle vane members 70 are mounted in stationary fashion by apparatus standard in the art, and the nozzle vane members direct the hot air flow onto the blades 46 to rotate the rotor.

Also mounted in stationary fashion is a deswirl assembly 72, to which is supplied coolant flow diverted from the compressor of the turbine engine. The deswirl assembly 72 contains an optional metering orifice 74 for admitting a preselected amount of coolant flow to the cooling apparatus. Other configurations previously known in the art may also be utilized in the deswirl assembly 72. A preswirl assembly 76 is fastened to the deswirl assembly 72 by a number of bolts 78 and nuts 80. The preswirl assembly 76 includes annular seal portions 82, 84 which are adjacent the rotating labyrinth seals 66, 68, respectively, contained on the seal plate.

Figure 8:
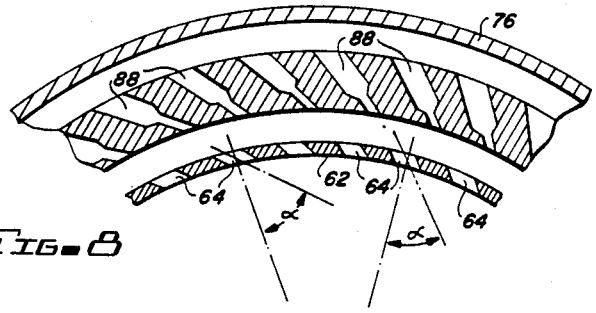
FIG. 8 is a partial cross-sectional view of an alternative embodiment utilizing nozzles to provide the overswirled cooling air.

The preswirl assembly 76 is designed to inject cooling air radially inwardly toward the seal plate 62 at the location of the apertures 64 while simultaneously imparting the cooling air with a tangential velocity substantially greater than the tangential velocity of the seal plate 62 at the location of the apertures 64 where coolant flow is injected into the rotor, thereby resulting in an overswirl condition. The preswirl assembly 76 in the preferred embodiment utilizes preswirl vanes 86 located in an annular array in the preswirl assembly about the axis of the rotor. The preswirl vanes 86 are best shown in FIG. 4. In an alternative embodiment illustrated in FIG. 8, angled nozzles 88 of the configuration shown may be utilized instead of the preswirl vanes 86. It has been found, however, that it is preferable to use preswirl vanes 86 rather than preswirl nozzles 88 since the preswirl vanes 86 present a higher overall aerodynamic efficiency.

It may thereby be seen that the coolant flow is injected inwardly towards the seal plate 62 by the preswirl vanes 86, which give the coolant flow a tangential velocity substantially greater than the tangential velocity of the seal plate 62 at the location of the apertures 64. At this point, the reason for having the apertures 64 angled is readily apparent, since the overswirled coolant flow moves in the same direction as the rotor but at a faster velocity than the seal plate at the location of the aperture 64. Therefore, the angle of the apertures enables the overswirled coolant flow to pass therethrough with fewer overall losses than if the apertures 64 were not angled. The oval configuration of the apertures 64 illustrated in FIG. 10 and resulting from the apertures 64 being angled has been found to minimize stresses in the seal plate 62.

Figure 9:
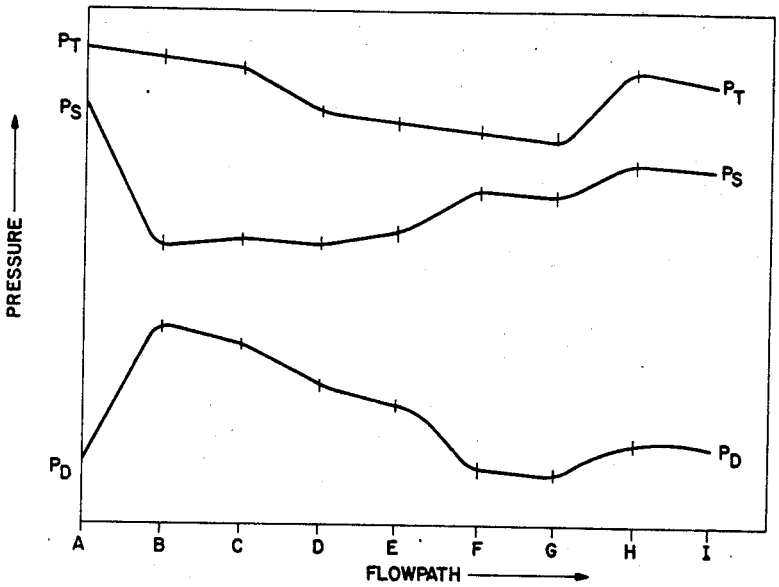
FIG. 9 is a graph showing dynamic pressure, static pressure, and total pressure of the cooling air at various locations in the device illustrated in FIG. 5.

In order to better understand the operation of the present invention and the advantages incident thereto, it is helpful to illustrate the passage of the coolant flow through the various channels from the preswirl assembly 76 to the internal passages 50, 52, and 54 in the blade 46. Accordingly, the chart in FIG. 9 illustrating dynamic pressure, static pressure, and total pressure has been prepared for discussion in relation to the cutaway view of the device in FIG. 5 to illustrate a typical example of the pressures of the cooling air as it is supplied to the blade 46. For purposes of this example, total pressure $P_T$ is defined as dynamic pressure $P_D$ plus static pressure $P_S$.

Cooling air upstream of the preswirl assembly 76 preswirl vanes 86 has pressure characteristics indicated by point A, representing very low dynamic pressure and high static pressure. Typically, in the preswirl assembly 76 static pressure may be very close to total pressure of the cooling air. Moving to location B at the throat between the preswirl vanes 86, static pressure is falling off sharply and dynamic pressure is increasing substantially. Total pressure has dropped off by a small amount attributable to friction caused by the coolant flow passing through the preswirl vanes 86.

In location C between the preswirl vanes and the portion of the seal plate 62 containing the apertures 64, the coolant flow has a tangential velocity substantially larger than the tangential velocity of the seal plate 62 at the apertures 64, representing an overswirl condition. Total pressure has dropped off slightly due to non-laminar air flow, trailing edge wakes, and turbulence. Since the coolant flow is in an overswirl condition, static pressure at location C is still substantially smaller than static pressure at location A. This low static pressure minimizes seal leakage through the labyrinth seals 66, 68.

The amount of overswirl desirable to produce with the preswirl vanes 86 varies according to several considerations. Generally speaking, the more overswirl present in the device the greater will be the aerodynamic efficiency of the device. The countervailing consideration is that the more overswirl produced by the device, the lower will be the static pressure at location C, a consideration which could, if carried to an extreme, adversely affect blade cooling. Therefore, the amount of overswirl the present invention seeks to produce is that amount sufficient for providing an adequate amount of pressure at the blade cooling entry channel 56 (FIG. 3).

It has been found that the maximum amount of overswirl which may be used in a viable device is about 125%, where the tangential velocity of the coolant flow is 2.25 times the tangential velocity of the seal plate 62 at the location of the aperture 64. As a minimum, a 10% overswirl has been found to be the minimum amount necessary to move the coolant flow to the inner end of the pumping vane 60 of the preferred embodiment with an overswirl condition. Therefore, the amount of overswirl may be varied between 10% and 125%, with an actual amount nearer the lower figure representing the greater overall efficiency.

Moving to location D, where the coolant flow has just passed through the apertures 64 in the seal plate 62, it may be seen that dynamic and total pressure have dropped off slightly due to friction. While static pressure could have moved either way, as shown in FIG. 9 it is somewhat more likely to drop slightly. As the coolant flow moves within the rotor to location E, friction will cause a small drop in total pressure and dynamic pressure. Static pressure increases slightly because of a slight slowing of the coolant flow flow.

Moving to location F just below the pumping vane 60, friction has dropped total pressure, and momentum has dropped dynamic pressure and increased static pressure. It is important to note that at location F, tangential velocity of the coolant flow flow should be at least the tangential velocity of the rotor at this location to minimize pressure losses. Moving to location G which is at the bottom of the pumping vane 60, there is very little change in pressure from location F of any kind. Static, dynamic, and total pressure all decrease slightly due to the converging area caused by the presence of the tips of the pumping vanes 60. In the preferred embodiment, the inner tips of the pumping vanes 60 are rounded as shown in FIG. 3 to minimize these pressure drops.

At this point, it must be noted that, as illustrated in FIG. 3, the pumping vanes 60 slightly widen as radial distance from the center of the rotor increases. Despite this configuration, as the coolant flow moves from location G to location H of FIG. 5, there will be a tendency of the air to diffuse somewhat due to an increased area between the vanes from location G to location H. Therefore, not only will the pumping vanes 60 be pumping the coolant flow flow, they will also to some extent act to diffuse it.

Dynamic pressure will increase from locations G to H due to pumping and decrease somewhat due to diffusion, resulting in an overall increase in dynamic pressure. Total pressure will increase due to pumping, and static pressure will increase due to diffusion and pumping. For optimum aerodynamic design, at location H the tangential velocity of the cooling air is the same as the tangential velocity of the blade assembly at the blade cooling entry channel 56 to allow entry of the coolant flow into the blade with minimal entrance losses.

Finally, at location I, static, dynamic, and total pressures have dropped slightly due to entrance losses as the coolant flow flow goes into the blade cooling entry channel 56, and from there to the cooling passages 50, 52, and 54. These losses are minimized by maintaining identical velocities of the coolant flow flow and the wheel, as described above.

The advantages of the present invention may now be fully appreciated, and involve substantial reductions in the insertion and pumping losses coupled with a high level of efficiency in delivery of the coolant flow to the blade 46. Insertion losses are minimized by overswirling the coolant flow, angling the apertures 64 in the seal plate 62 to reduce wheel drag, and properly sizing the apertures 64 as well as by encountering low labyrinth seal leakage due to the low static pressure caused by the overswirl condition of the coolant flow at the seal location. Pumping losses are minimized by using overswirling rather than primarily pumping to supply the coolant flow to the blade, thereby keeping the air temperature of the coolant flow low while still supplying acceptable blade coolant flow supply pressure. Finally, the present invention accomplishes these advantages without substantial disadvantage, even minimizing stresses in the rotating portion of the turbine engine by using radial inboard coolant flow injection at a low diameter into the seal plate 62 to minimize stresses.

What is claimed is:

1. A device for delivering coolant flow to a plurality of rotor blades mounted about the outer periphery of a rotor disc, said rotor disc being mounted onto and extending radially outwardly from a rotor contained in a gas turbine engine, said device comprising:

a stationary preswirl assembly mounted circumferentially about a location on said rotor and spaced away from said disc, said preswirl assembly being supplied with pressurized coolant flow, said preswirl assembly arranged and configured to direct said pressurized coolant flow radially inwardly towards said location while simultaneously imparting a tangential velocity to said coolant flow;

means for forming an internal passageway rotating with said rotor;

means for admitting said coolant flow directed radially inwardly towards said location on said rotor into said internal passageway, said coolant flow being channeled within said internal passageway from said location on said rotor to said blades, the tangential velocity imparted to said coolant flow being sufficiently higher than the tangential velocity of said rotor at said location to ensure that the tangential velocity of said coolant flow, at the location said coolant flow is supplied to said blades, exceeds the tangential velocity of said blades at the location said coolant flow is supplied to said blades to form an overswirled flow, wherein said coolant flow is overswirled between 10% and 125% by said preswirl assembly.

2. A device as defined in claim 1, additionally comprising:

means for boosting the pressure of the coolant flow before said coolant flow is supplied to said rotor blades.

3. A device as defined in claim 2, wherein said boosting means comprises:

a pumping vane located within said internal passageway and along said rotor disc near said blades.

4. A device as defined in claim 3, wherein said pumping vane is made integrally with a rotor blade.

5. A device as defined in claim 1, wherein said preswirl assembly is annular in shape, surrounding and spaced away from said rotor at said location.

6. A device as defined in claim 1, additionally comprising:

means for providing a seal between said stationary preswirl assembly and said rotor to prevent loss of coolant.

7. A device as defined in claim 6, wherein said means for providing a seal comprises:

a first labyrinth seal extending circumferentially around said rotor on one side of said admitting means;

a second labyrinth seal extending circumferentially around said rotor on the other side of said admitting means;

a first annular seal portion contained in said preswirl assembly on one side of said directing means and adjacent said first labyrinth seal;

a second annular seal portion contained in said preswirl assembly on the other side of said directing means and adjacent said second labyrinth seal.

8. A device as defined in claim 1, wherein said preswirl assembly includes a plurality of angled nozzles disposed in an annular array.

9. A device as defined in claim 1, wherein said forming means comprises:

a seal plate mounted at one end thereof onto said rotor and at the other end thereof onto said rotor blades, said internal passageway being defined by and between said seal plate and the assembly comprising said rotor, said rotor disc, and said rotor blades.

* * * * *